US005157212A

United States Patent [19]

Fleming

[11] Patent Number: 5,157,212

[45] Date of Patent: Oct. 20, 1992

[54] DRUM TENSIONING APPARATUS

[76] Inventor: John R. Fleming, 2917-B Los Amigos Ct., Las Cruces, N. Mex. 88001

[21] Appl. No.: 655,110

[22] Filed: Feb. 14, 1991

[51] Int. Cl.[5] ..... G10D 13/02

[52] U.S. Cl. ..... 84/413; 84/419

[58] Field of Search ..... 84/413, 419

[56] References Cited

U.S. PATENT DOCUMENTS

| | | | |
|---|---|---|---|
| 2,061,244 | 11/1936 | Au-Miller | 84/413 |
| 3,590,680 | 7/1971 | Carnes et al. | 84/419 |
| 4,023,462 | 5/1977 | Denov et al. | 84/419 |

FOREIGN PATENT DOCUMENTS

| | | | |
|---|---|---|---|
| 667300 | 9/1964 | Italy | 84/419 |

*Primary Examiner*—W. B. Perkey

*Assistant Examiner*—Cassandra Spyrou

*Attorney, Agent, or Firm*—Pravel, Gambrell, Hewitt, Kimball & Krieger

[57] ABSTRACT

An apparatus for varying the tension on a drum head to change the pitch of the instrument during a performance. The apparatus may be configured to tension one drum or several drums simultaneously. The tensioning components of the apparatus are installed within the barrel of the drum and the apparatus is actuated by the performer using a control module which may incorporate a system for foot pedals, proximity switches, or photoelectric switches. The control module may be programmed to effect the alteration of drum pitch in variable increments and at variable speeds. The apparatus is electrically powered and is suitable for installation in any type of drum, including those with open-ended barrels.

21 Claims, 1 Drawing Sheet

FIG. 1
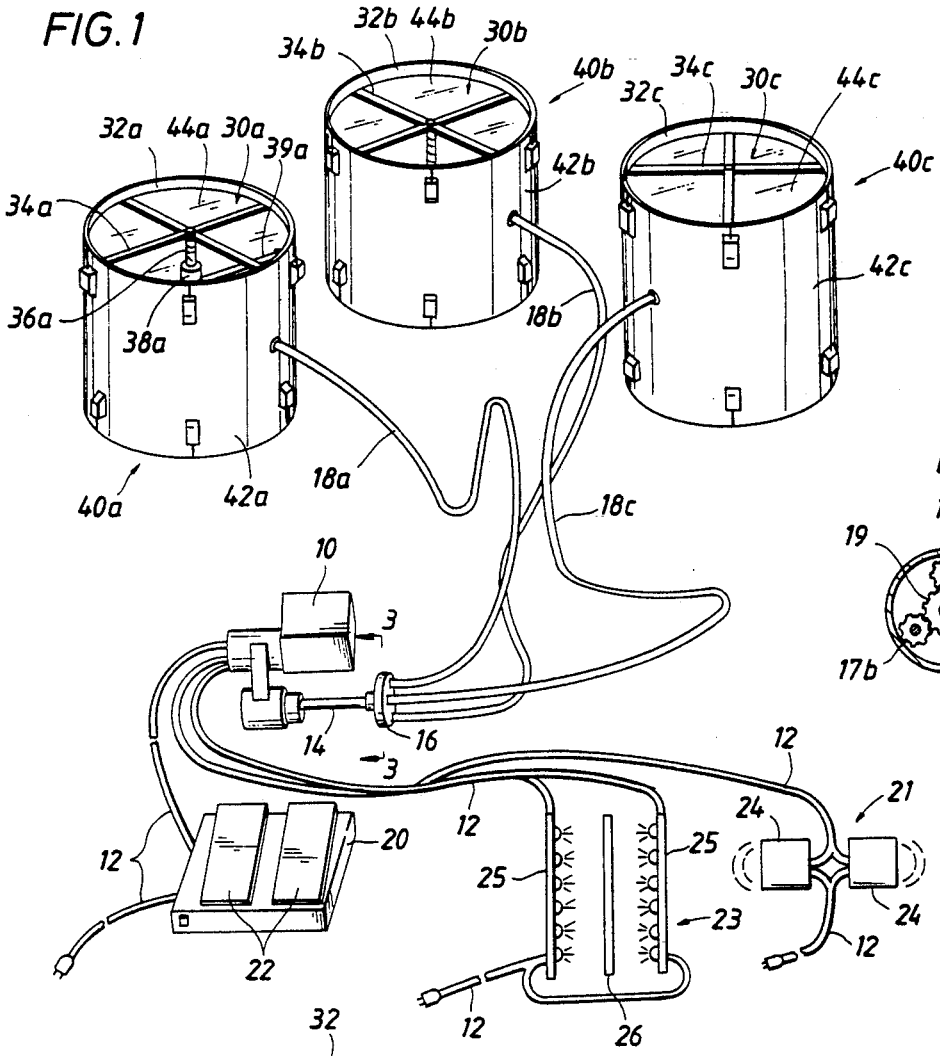
FIG. 3
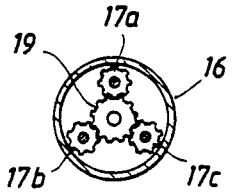
FIG. 4
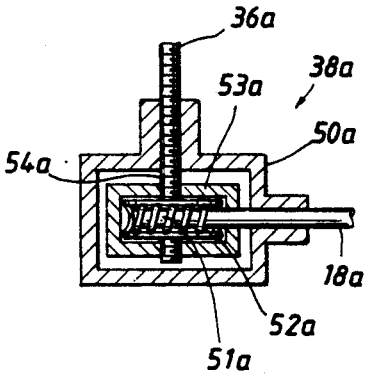
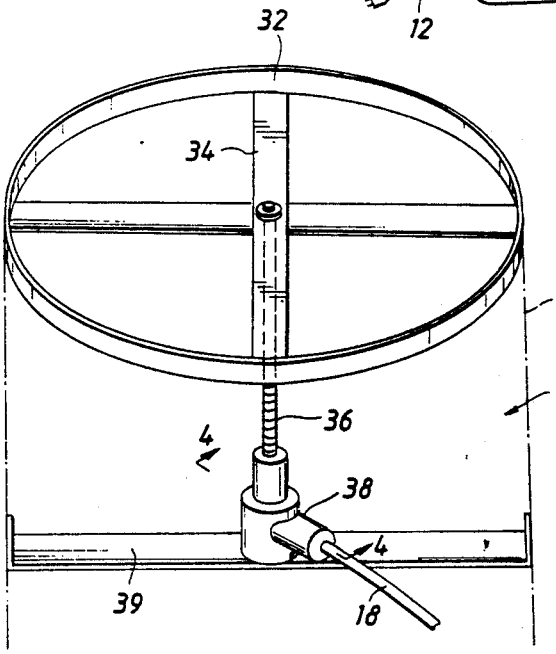
FIG. 2

DRUM TENSIONING APPARATUS

BACKGROUND OF THE INVENTION

1. Field of The Invention

The present invention is directed to the field of musical instruments. More particularly, it relates to an apparatus for instantaneously varying the tension on a drum head to change the pitch of the instrument while it is being played.

2. Description of Related Art

The pitch of a percussion type musical instrument, such as a drum, is dependent upon the tension in the head covering the instrument. The pitch of the tone produced by striking the instrument is raised by increasing the tension in the head. Similarly, by decreasing the tension in the head, the pitch of the tone is lowered.

A drum head may be manually tensioned before a performance to produce a desired tone. An apparatus for manually tensioning a drum head is disclosed in U.S. Pat. No. 2,061,244. This apparatus requires that the musician manually turn a crank to change the pitch of the drum. When manual tensioning is employed it is very difficult or impossible to vary the tone of the instrument during a performance and several drums, each tuned to a different pitch, may be required to perform a given composition. An electronic device for automatically tuning a drum to a selected pitch is disclosed in U.S. Pat. No. 4,023,462. This device eliminates the need for the musician to manually adjust the tension in the drum head, but it is not entirely suitable for varying the pitch of the drum repeatedly during a performance.

It is therefore desirable for a musician to have the capability of instantaneously changing the pitch of a drum during a performance. In addition to providing a range of tones from a single instrument, such a capability may reduce the number of drums required for the performance.

At least one technique by which drum head tension may be varied during a performance is known in the prior art. This technique, disclosed in U.S. Pat. No. 3,590,680, involves pressurizing the drum with compressed air or gas and selectively varying the gas pressure, thereby varying the pitch of the drum. This method of drum pitch control requires that the drum itself be made essentially gas tight. Many types of drums, however, are made of gas-permeable materials and/or are designed with open-ended barrels to achieve specific sound qualities. The gas pressure method of pitch control is thus inapplicable to most drums.

Because it is often desirable to vary the pitch of drums during a musical performance, there is a need for a drum head tension control system which is adaptable to all drum types.

SUMMARY OF THE INVENTION

The present invention is directed to an apparatus capable of instantaneously changing the tension on a drum head during a musical performance to vary the pitch and quality of the drum sound. The invention utilizes a rigid ring, concentric with, and installed within, the drum barrel, to apply pressure on the drum head. The drum head tensioning ring is supported by a frame connected to an actuation mechanism for moving the ring against the drum head. The ring actuation mechanism is driven by means of a power supply mechanism capable of instantaneous directional reversal. The musician can thus control the pitch of one or more drums from a central control apparatus by causing the power supply mechanism to drive the ring actuation mechanism in the appropriate direction, either applying or releasing tension on the drum head. The control apparatus is capable of being programmed to alter drum pitch in increments and at variable speeds.

The apparatus according to the present invention is thus able to provide an effective means of raising or lowering the pitch of one or more drums instantaneously during a musical performance.

Further, the apparatus according to the present invention is able to alter drum pitch by one or more preselected increments and at variable speeds.

Still further, the apparatus according to the present invention is suitable for installation in all types of drums, including open barrel designs.

BRIEF DESCRIPTION OF THE DRAWINGS

The present invention will be more fully understood when the following detailed description of the preferred embodiment is considered with the accompanying drawings in which:

FIG. 1 is a perspective view of a drum tensioning apparatus of the present invention, configured to control the tension of the heads of several drums simultaneously;

FIG. 2 is a perspective view of a drum head tensioning ring and its supporting frame and actuation mechanism;

FIG. 3 is a sectional elevation view taken along line 3—3 of FIG. 1 of the transmission for controlling the tension of the heads of several drums simultaneously; and FIG. 4 is a sectional elevation view taken along line 4—4 of FIG. 2 of the drum had tensioning ring actuator.

DESCRIPTION OF THE PREFERRED EMBODIMENT

Referring now to FIG. 1, the drum tensioning apparatus of the present invention includes an electric motor 10, an electric cable 12, a power shaft 14, a transmission 16, output shafts 18*a*, 18*b*, and 18*c*, a control actuator 20, control pedals 22, and drum head tensioning assemblies generally indicated by the reference numerals 30*a*, 30*b*, and 30*c*.

The drum tensioning apparatus is actuated by means of an electric motor 10, which is powered by electric current supplied through electric cables 12. Electric motor 10 is capable of causing instantaneous reversal of the direction of rotation of power shaft 14. Power shaft 14 is capable of rotation in either a clockwise or a counter-clockwise direction and at any speed up to the maximum speed of electric motor 10. The direction, speed, and extent of rotation of power shaft 14 are controlled by a musician operating control actuator 20 by means of input signals produced by control pedals 22. Alternative embodiments of the present invention may employ other means of interface with control actuator 20. These alternative means may include knee-operated control pedals or hand-operated control panels. Other means of actuating electric motor 10 include the use of proximity switches 21 or photoelectric switches 23. Proximity switches 21 include dual source heads 24 which produce magnetic fields. When the musician places a portion of his body near either source head 24 the magnetic field is disturbed and the source head 24 senses this disturbance. The source head 24 translates this disturbance into a signal to actuate electric motor 10.

Photoelectric switches 23 include multiple light sources 25 and a reflector 26. When the musician places a portion of his body between a light source 25 and reflector 26, the photoelectric switch 23 senses the interruption in the reflected light beam and produces a signal to actuate electric motor 10. Control actuator 20 is capable of being programmed to alter drum pitch continuously or in variable increments and at variable speeds. Power shaft 14 provides input power to transmission 16.

As illustrated in FIG. 3, transmission 16, incorporates multiple spur gears 17*a*, 17*b*, and 17*c* arranged about a central spur gear 19 and distributes the input power to multiple output shafts 18*a*, 18*b*, and 18*c*. Output shafts 18*a*, 18*b*, and 18*c* are comprised of flexible cables capable of transmitting torque. Each of output shafts 18*a*, 18*b*, and 18*c* is connected to drum head tensioning assemblies, 30*a*, 30*b*, and 30*c*, installed in drums, generally indicated by the reference numerals 40*a*, 40*b*, and 40*c*.

Drums 40*a*, 40*b*, and 40*c* consist generally of a barrel, 42*a*, 42*b*, and 42*c*, and a head, 44*a*, 44*b*, and 44*c*. Depending upon the direction of rotation of output shafts, 18*a*, 18*b*, and 18*c*, drum head tensioning assemblies, 30*a*, 30*b*, and 30*c*, act simultaneously to either increase or decrease the tension on drum heads, 44*a*, 44*b*, and 44*c*. Each of control pedals 22 controls a single function of the drum tensioning apparatus, serving either to increase or decrease tension on drum heads, 44*a*, 44*b*, and 44*c*. Depending upon which of control pedals 22 is depressed, and the extent to which it is depressed, the tone of drums, 40*a*, 40*b*, and 40*c*, is raised or lowered. The process by which drum head tensioning assemblies, 30*a*, 30*b*, and 30*c*, act to vary the tension on drum heads, 44*a*, 44*b*, and 44*c*, will be more fully discussed below in conjunction with FIG. 2.

Alternative embodiments of the present invention may incorporate other suitable means, including pressurized fluid, for actuating drum head tensioning assemblies, 30*a*, 30*b*, and 30*c*.

Referring now to FIG. 2, the drum head tensioning assembly, generally indicated by the reference numeral 30, includes a tensioning ring 32, a tensioning ring frame 34, a tensioning ring drive shaft 36, a tensioning ring actuator 38, and a tensioning ring actuator support 39. Tensioning ring actuator 38 can be any convenient device such as a gear nut or screw jack. One drum head tensioning assembly is deployed per drum. The drum head tensioning assembly is entirely contained within the barrel of the drum. For clarity, only drum 40*a* is described below. Tensioning ring actuator support 39*a* attaches to barrel, 42*a*, of drum, 40*a*, and supports drum head tensioning assembly, 30*a*, within drum, 40*a*. Tensioning ring 32*a*, slightly smaller in diameter than barrel 42*a*, abuts against the inside of drum head, 44*a*, and is held in position by tensioning ring frame 34*a*. Tensioning ring frame 34*a* is supported at its center by tensioning ring drive shaft 36*a*. The tensioning ring drive shaft 36*a* is movable along its axis and is actuated by tensioning ring actuator 38*a*. Tensioning ring actuator 38*a* is more fully illustrated in FIG. 4. Tensioning ring actuator 38*a* acts to convert the rotary motion of output shaft 18*a* to linear motion of tensioning ring drive shaft 36*a*. Tensioning ring actuator 38*a* is comprised of a housing 50*a*, a right angle gear reducer, including worm 51*a* and worm gear 52*a*, connected to a screw jack attached to tensioning ring drive shaft 36*a*. Worm 51*a* is fitted to the end of output shaft 18*a* and rotates with output shaft 18*a*. Worm 51*a* meshes with worm gear 52*a*. Worm gear 52*a* is confined to rotate only within bearing block 53*a*. Tensioning ring drive shaft 36*a* passes through worm gear 52*a* and forms the axis of rotation of worm gear 52*a*. The bore of worm gear 52*a* is threaded to mesh with the threads 54*a* on tensioning ring drive shaft 36*a*. Thus rotation of output shaft 18*a* causes tensioning ring drive shaft 36*a* to displace linearly. Alternative embodiments of the present invention which utilize a pressurized fluid to actuate tensioning ring 32*a* incorporate a piston-cylinder or rotary activator tensioning ring actuator to convert fluid pressure to linear motion of tensioning ring drive shaft 36*a*.

When tensioning ring drive shaft 36*a* is moved toward drum head 44*a*, tensioning ring 32*a* exerts pressure on drum head 44*a*, raising the pitch of drum 40*a*. Conversely, when tensioning ring actuator 38*a* moves tensioning ring drive shaft 36*a* in the direction away from drum head 44*a*, the pressure which tensioning ring 32*a* exerts on drum head 44*a* is reduced, thereby lowering the pitch of drum 40*a*.

Although the invention has been described with reference to its preferred embodiment, those of ordinary skill in the art may, upon reading this disclosure, appreciate changes and modifications which do not depart from the scope and spirit of the invention as described above or claimed hereafter.

What is claimed is:

1. An apparatus for tensioning a drum, wherein the drum is comprised of a barrel having at least one open end and at least one drum head held in tension across the open end of the barrel, and wherein the drum head, when struck, produces a musical tone of a particular pitch, which pitch is dependent upon the tension in the drum head, said apparatus acting on the drum head by variably applying mechanical pressure to the drum head to alter the pitch of the tone produced by striking the drum head and comprising:

power supply means capable of producing motive force of a predetermined strength acting in a predetermined direction and capable of reversing the direction and changing the strength of the motive force;

an output member operably connected to said power supply means and capable of motion to transmit the motive force;

control means operably connected to said power supply means and capable of receiving an input signal and effecting a corresponding change in the direction and/or strength of the motive force; and a drum head tensioning member, operably connected to said output member and the drum head, wherein said drum head tensioning member is entirely contained within the barrel of the drum and is capable of alternately exerting and relieving pressure on the drum head in response to the motion of said output member.

2. Apparatus of claim 1 wherein said power supply means is an electrically powered linear actuator gear motor.

3. Apparatus of claim 1 wherein said output member is a shaft.

4. Apparatus of claim 3 wherein said output member further comprises a cable capable of transmitting torque.

5. Apparatus of claim 1 wherein said control means includes switches for receiving the input signal from a human operator.

6. Apparatus of claim 5 further comprising a plurality of proximity switches, wherein said control means includes switches for receiving input signals from proximity switches.

7. Apparatus of claim 5 further comprising a plurality of photoelectric switches, wherein said control means includes switches for receiving the input signal from photoelectric switches.

8. Apparatus of claim 1 wherein said control means is a programmable controller which effects discrete motions of said output member at variable speeds.

9. Apparatus of claim 1 wherein said drum head tensioning member comprises:

multiple support members; and a ring member operably attached to said multiple support members.

10. An apparatus for tensioning a drum, whereby the drum is comprised of a barrel having at least one open end and at least one drum head held in tension across the open end of the barrel, and wherein the drum head, when struck, produces a musical tone of a particular pitch, which pitch is dependent upon the tension in the drum head, said apparatus acting on the drum head by variably applying mechanical pressure to the drum head to alter the pitch of the tone produced by striking the drum head and comprising:

power supply means capable of producing motive force of a predetermined strength acting in a predetermined direction and capable of reversing the direction and changing the strength of the motive force;

a primary output member operably connected to said power supply means and capable of motion to transmit the motive force;

control means operably connected to said power supply means and capable of receiving an input signal, and effecting a corresponding change in the direction and/or strength of the motive force;

motion transmission means operably connected to said primary output member and capable of multiplying the motion of said primary output member;

a secondary output member operably connected to said motion transmission means and capable of motion in response to an input from said motion transmission means;

motion conversion means operably connected to said secondary output member and capable of converting the motion of said secondary output member into linear motion;

a tertiary output member operably connected to said motion conversion means and capable of linear motion in response to an input motion from said motion conversion means; and a drum head tensioning member, operably connected to said tertiary output member and the drum head, wherein said drum head tensioning member is entirely contained within the barrel of the drum and is capable of alternately exerting and relieving pressure on the drum head in response to the linear motion of said tertiary output member.

11. Apparatus of claim 10 wherein said power supply means is an electrically powered linear actuator gear motor.

12. Apparatus of claim 10 wherein said primary output member is a shaft.

13. Apparatus of claim 10 wherein said control means includes switches for receiving the input signal from a human operator.

14. Apparatus of claim 13 further comprising a plurality of proximity switches, wherein said control means includes switches for receiving input signals from proximity switches.

15. Apparatus of claim 13 further comprising a plurality of photoelectric switches, wherein said control means includes switches for receiving the input signal from photoelectric switches.

16. Apparatus of claim 10 wherein said control means is a programmable controller which effects discrete motions of said primary output member at variable speeds.

17. Apparatus of claim 10 wherein said motion transmission means comprises a plurality of spur gears arranged about and operably connected to a central spur gear.

18. Apparatus of claim 10 wherein said secondary output member is a shaft.

19. Apparatus of claim 10 wherein said secondary output member is a cable capable of transmitting torque.

20. Apparatus of claim 10 wherein said motion conversion means comprises:

a right angle gear reducer means operably connected to a gear nut or screw jack.

21. Apparatus of claim 10 further comprising:

a plurality of secondary output members operably connected to said motion transmission means;

a plurality of motion conversion means each operably connected to one of said secondary output members;

a plurality of tertiary output members each operably connected to one of said motion conversion means; and a plurality of drum head tensioning members each operably connected to one of said tertiary output members and to the head of one of a plurality of drums.

* * * * *